United States Patent [19]

Toliusis

[11] Patent Number: 4,823,842

[45] Date of Patent: Apr. 25, 1989

[54] SINGLE-STEM FOUR-WAY VALVE

[75] Inventor: Vytautas J. Toliusis, Van Buren County, Mich.

[73] Assignee: Humphrey Products Company, Kalamazoo, Mich.

[21] Appl. No.: 158,084

[22] Filed: Feb. 16, 1988

Related U.S. Application Data

[63] Continuation of Ser. No. 97,818, Sep. 16, 1987, abandoned.

[51] Int. Cl.[4] ..... F15B 13/044

[52] U.S. Cl. ..... 137/625.65; 137/625.26

[58] Field of Search ..... 137/625.26, 625.27, 137/625.65

[56] References Cited

U.S. PATENT DOCUMENTS

| | | | |
|---|---|---|---|
| 4,026,325 | 5/1977 | Loveless | 137/625.26 |
| 4,187,884 | 2/1980 | Loveless . | |
| 4,494,572 | 1/1985 | Loveless | 137/596.17 |

OTHER PUBLICATIONS

Koganei brochure, pp. 19–20 "Solenoid Valves 040 Series".

Mac brochure, pp. D-45-1-D-45-4 "45 Series".

*Primary Examiner*—Gerald A. Michalsky

*Attorney, Agent, or Firm*—Flynn, Thiel, Boutell & Tanis

[57] ABSTRACT

A four-way valve assembly provided with a housing having an elongate bore in which a single shiftable valve is slidably disposed. The housing has a main center part and a pair of end parts attached to opposite side thereof. A pair of sleevelike liners are disposed in the bore, and an inlet port communicates with the bore in the region between adjacent inner ends of the liners. A pair of load ports communicate with the bore through the individual liners and are spaced axially on opposite sides of the inlet port. A pair of exhaust ports are provided, one in each end housing part, for communication with the bore. The single valve has an elastic poppet mounted centrally thereof and disposed to axially shift between and sealingly coact with valve seats formed on the opposed inner ends of the liners. Each liner has a sleevelike hub part at its outer end which is received within the bore of the respectively adjacent end part so that the latter is concentrically seated on the hub part.

10 Claims, 2 Drawing Sheets

SINGLE-STEM FOUR-WAY VALVE

This application is a continuation of U.S. Ser. No. 097 818, filed Sept. 16, 1987, now abandoned.

FIELD OF THE INVENTION

This invention relates to an improved four-way valve assembly employing a single shiftable valve which is preferably a poppet-type valve.

BACKGROUND OF THE INVENTION

Numerous four-way valve assembles have been developed for controlling both liquids and gases, and such assemblies incorporate a wide range of structural and functional features. Such four-way valve assemblies have, for many years, been of substantial size and have often incorporated multiple shiftable valves in order to provide for proper control over fluid flow. Modern technology, however, has increasingly demanded that such valve assemblies be made of extremely small and compact size, particularly when such assemblies are utilized in pneumatic control circuits and the like, and in addition such assemblies must be capable of permitting shifting of the valve with extremely small forces without detracting from the desired response time.

One of the common problems associated with many known four-way valves, particularly when they utilize shiftable valves of the poppet type, has been the fact that such assemblies often require at least two poppet-type shiftable valve stems in order to provide the desired structural and functional relationships. The use of multiple shiftable valve stems increases the structural complexity of the valve assembly, including both the size and functional characteristics, and also significantly increases the manufacturing cost. The use of multiple valve stems also increases the number of wear points subject to failure and/or maintenance.

Another problem encountered with conventional four-way valve assemblies, including those which use either single or multiple shiftable valve stems, has been the difficulty in achieving a minimum shifting force. The valve industry has, for many years, attempted to improve valve operation by providing at least a partial pressure balance upon the shiftable valve stem so as to minimize shifting forces. This balance is achieved by locating the seals and pressure areas in such manner as to avoid the application of large unbalanced pressure forces on the shiftable valve stem. While great strides have been made in achieving at least a partial balance on the shiftable valve stem, nevertheless this goal is not always optimized in view of the overall structural and functional relationships which exist between the shiftable valve stem and the other operational characteristics of the assembly.

Still another problem associated with known valve assemblies, particularly in those assemblies which are of extremely small size so as to be suitable for use in control systems, such as pneumatic control circuits, is the difficulty in maintaining proper tolerances including concentric relationships between the shiftable valve stem and its housing so as to permit optimum performance including minimization of shifting force. This precision of manufacture has often been compromised in view of difficulties in achieving such manufacture, or at least the impracticality of doing so at reasonable cost.

Accordingly, it is an object of the present invention to provide an improved four-way valve assembly which greatly improves upon, and in fact overcomes, many of the disadvantages associated with prior structures as briefly described above.

More specifically, it is an object of the present invention to provide an improved four-way valve assembly which is highly desirable for use in controlling flow of a gas, such as for use in a pneumatic control system, by employing a single shiftable valve for controlling the four flow functions, which is of an extremely small and compact spacial arrangement, and which can be economically manufactured and assembled while maintaining and utilizing a shiftable valve of extremely small cross-sectional size while maintaining desirable tolerances and sliding fits.

It is also an object of the invention to provide an improved four-way valve assembly, as aforesaid, which is capable of providing an extremely small shifting force, both due to the manner in which the shiftable valve is slidably supported, and due also to the achievement of a pressure balance which is at least of a high degree so as to permit prompt and rapid shifting while employing a minimal shifting force.

In the improved four-way valve assembly of the present invention, and specifically in the preferred embodiment thereof, there is provided a housing having an elongate bore in which is slidably disposed a single shiftable valve of the poppet type. The housing includes a main center housing part and a pair of end housing parts which removably attach to opposite ends of the center part and cooperate therewith for defining the elongate bore. A pair of sleevelike liners are stationarily disposed in the bore and cooperate with the housing for defining an inlet port which communicates with the bore in the region between the adjacent ends of the liners, and a pair of load ports which communicate with the bore through the individual liners and are spaced axially on opposite sides of the inlet port. A pair of exhaust ports are provided in the housing, one in each end housing part, for communication with the bore. The single valve has a poppet mounted centrally thereof and disposed so as to axially shift between and sealingly coact with valve seats formed on the opposed inner ends of the liners. The opposite free ends of the valve are slidably supported within seal rings, such as cup seals, which are mounted on the end housing parts outwardly from the respectively adjacent exhaust ports to maintain a pressure balance on the valve stem. Each of the liners has a sleevelike hub part at its outer end which projects outwardly beyond the center body part and is received within the bore of the respectively adjacent end housing part so that the latter is concentrically seated on this hub part.

Other objects and purposes of the invention will be apparent to persons familiar with structures of this general type upon reading the following specification and inspecting the accompanying drawings.

Figure 1:
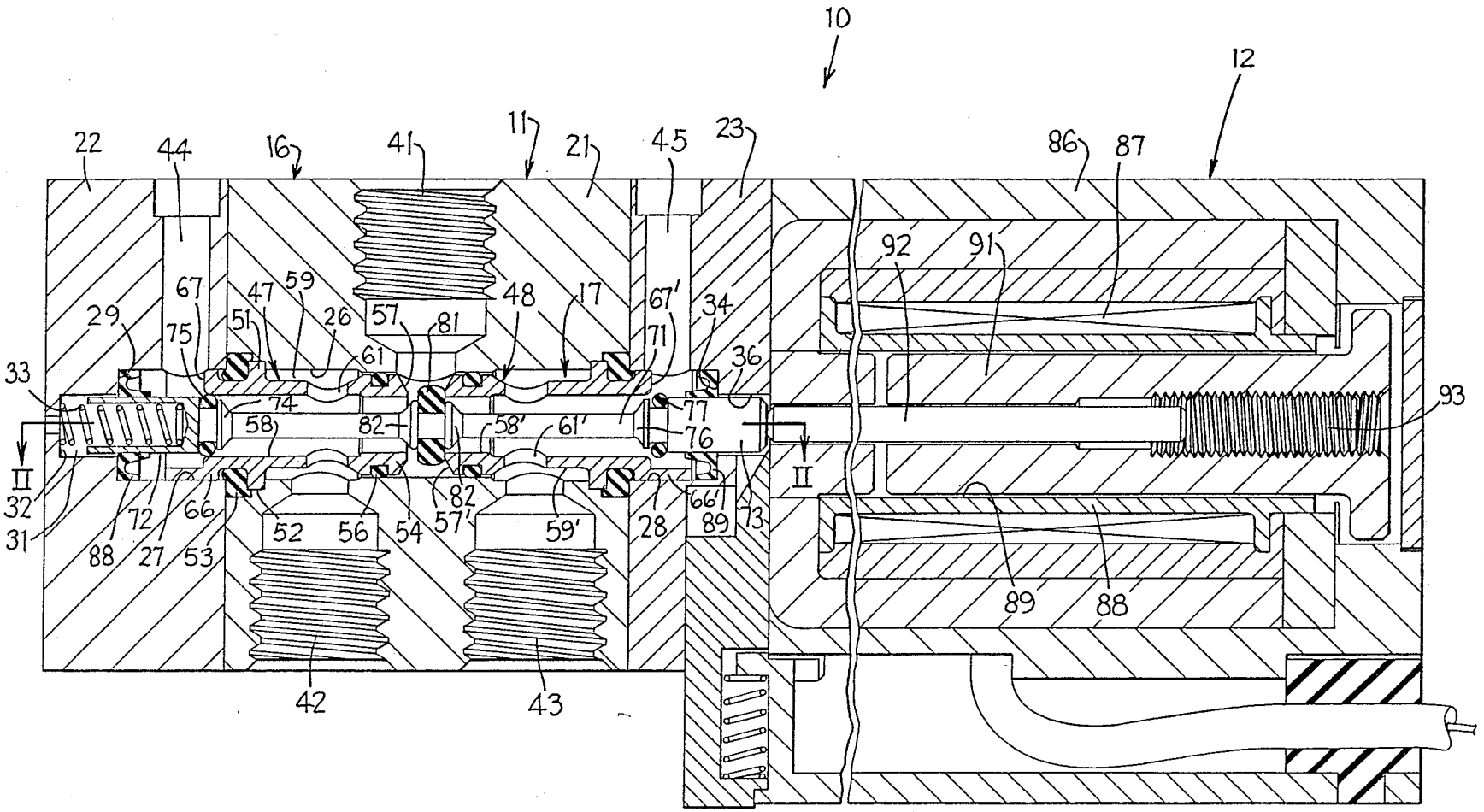
FIG. 1 is a longitudinal central sectional view of a valve unit incorporating the improved valve assembly of this invention.

Certain terminology will be used in the following description for convenience in reference only, and will not be limiting. For example, the words "upwardly", "downwardly", "leftwardly" and "rightwardly" will refer to directions in the drawings to which reference is made. The words "inwardly" and "outwardly" will refer to directions toward and away from, respectively, the geometric center of the valve assembly and designated parts thereof. Said terminology will include the words specifically mentioned, derivatives thereof and words of similar import.

DETAILED DESCRIPTION

FIG. 1 illustrates a valve unit 10 which is formed by a four-way valve assembly 11 connected to an operator assembly 12.

The valve assembly 11 includes a housing 16 having a substantially cylindrical bore formed therein, and a single shiftable valve 17 of the poppet type is axially slidably and sealingly disposed within the bore of the housing.

The housing 16 is formed by three parts which are releasably coupled together, as by bolts. More specifically, the housing includes a main or central housing part 21 having end housing parts 22 and 23 fixedly secured to the opposite ends thereof.

The aforementioned cylindrical bore is formed within all of these housing parts and includes a cylindrical bore portion 26 which extends longitudinally through the center housing part 21 so as to open outwardly through the opposite end faces thereof. The bore also includes an end bore portion 27 formed in the end housing part 22, and a similar cylindrical bore portion 28 formed in the other end housing part 23. These bore portions 27 and 28 are of the same diameter and substantially coaxially aligned with and form a continuation of the center bore portion 26. The bore portion 27 terminates in an annular shoulder 29, although this end housing part 22 has a further smaller diameter bore 31 which projects axially outwardly beyond the shoulder 29 and terminates in a shoulder or end wall 32. A conventional biasing means, such as a compression spring 33, is seated within this bore 31 and coacts with the adjacent end of the valve 17 to normally bias the latter rightwardly into one of its end operational positions, as explained hereinafter.

The bore portion 28 as formed in the end housing part 23 also terminates in an annular shoulder 34, and a further bore 36 of reduced diameter projects coaxially outwardly beyond this shoulder 34 and opens outwardly through the other end face of the housing part 23.

The housing includes at least four ports formed therethrough for communication with the bore. This includes an inlet port 41 which projects radially inwardly of the center housing part 21 for communication with the bore substantially adjacent the midpoint thereof. The center housing part 21 also has first and second load ports 42 and 43 formed radially thereof for communication with the bore. These load ports 42–43 are axially spaced so that the inlet port 41 is disposed substantially axially midway therebetween. The end housing part 22 has an exhaust or discharge port 44 formed therethrough for communication with the end of the bore, that is, specifically for communication with the end bore portion 27. The other end housing part 23 has a similar exhaust or discharge port 45 formed therethrough for communication with the respective bore portion 28. With this arrangement, as described above and as illustrated by FIG. 1, the first load port 42 communicates with the bore axially between the inlet port 41 and the discharge port 44, and the second load port 43 communicates with the bore at a location disposed axially between the inlet port 41 and the other discharge port 45.

To slidably but sealingly support the single valve 17 relative to the housing 16, a pair of sleevelike liners 47 and 48 are stationarily and sealingly supported on the housing within the bore. These liners 47 and 48 in turn have the valve 17 slidably supported therein. The liners 47 and 48 are identical, and are disposed in axially opposed relationship so that they are symmetrically positioned relative to a perpendicular radial plane passing through the central axis of the inlet port 41.

The liner 47, at its outer end, is defined with an annular flange portion 51 which is seated in an annular cylindrical enlargement formed inwardly from the end face of the center housing part so as to abut against a shoulder 52 to thereby axially position the liner relative to the center housing part. This annular flange portion 51 has a surrounding annular groove in which a resilient or elastomeric O-ring 53 is captivated, the latter being sealingly engaged with the center housing part. A further enlarged annular flange 54 is provided on the inner end of the liner 47, this flange being disposed axially closely adjacent one side of the inlet port 41. Flange 54 also has a surrounding annular groove in which is captivated a further elastomeric O-ring 56 which is maintained in sealing engagement with the center housing part. The flange 54, on the exposed axial end face thereof, defines an annular valve seat 57 which surrounds the bore 58 which extends axially throughout the liner. This valve seat 57 faces axially toward the other liner 48, and is normally provided with a slightly tapered and hence truncated conical configuration.

The liner 47, between the flanges 51 and 54, is relieved or of smaller outer diameter so as to define a surrounding annular groove 59 which communicates with the load port 42. The liner 47 also has at least one, and two in the illustrated embodiment, openings or ports 61 extending through the wall thereof to provide communication from the bore 58 to the surrounding groove 59 and thence communication with the load port 42.

The other liner 48 is, as noted above, identical to the liner 47 and has the same structural and cooperative relationships with the housing, specifically the center housing part. Hence, the same reference numerals are utilized as set forth above relative to the liner 47 except that the reference numerals have a prime (') added thereto.

When the liners 47 and 48 are positioned within the bore of the center housing part, the valve seats 57 and 57' face one another and are disposed a small axial distance apart. The inlet port 41 communicates directly with the region of the bore defined axially between the opposed valve seats 57 and 57', substantially as illustrated by FIG. 1.

The liner 47 also has, at the axially outer end thereof, a hub or sleeve part 66 which is integral with the liner and projects axially outwardly beyond the mounting flange portion 51. This hub part 66 has an outer diameter which closely conforms with the inner diameter of the end bore portion 27. Hub part 66 is snugly and concentrically received within the bore portion 27 and hence effects proper concentric alignment of the bore portion 27 relative to the center bore portion 26, and ensures that the end housing part 22 is properly aligned with the center housing part 21 when secured thereto.

This hub part 66 thus acts as a pilot to ensure that the housing parts are properly connected to provide proper alignment of the bore portions. This hub part 66 projects axially outwardly through a sufficient extent to ensure proper seating of the end housing part thereon, and since this normally causes the hub part to project axially at least partially across the respective discharge port 44, the hub part 66 is preferably provided with a slot or opening 67 extending radially therethrough so as to provide direct communication between the interior bore of the liner and the discharge port 44.

The other liner 48 has a sleeve or hub part 66' integrally associated therewith, which hub 66' structurally and functionally cooperates with the other end housing part 23 in the same manner described above relative to the hub part 66.

Considering now the valve 17, it includes a one-piece valve stem formed substantially by an elongated rod 71 which is of rather small diameter and projects coaxially of the bore 58—58'. This rod 71, adjacent the opposite axial free ends thereof, defines thereon cylindrical guide portions 72 and 73 which are somewhat axially elongated and of larger diameter. The guide portion 72 is axially slidably guided within the bore 31, and the other cylindrical guide portion 73 is similarly axially slidably guided within the bore 36. Guide portion 72 also has a recess or bore which opens outwardly through the free end thereof so as to receive and captivate therein one end of the biasing spring 33.

Figure 2:
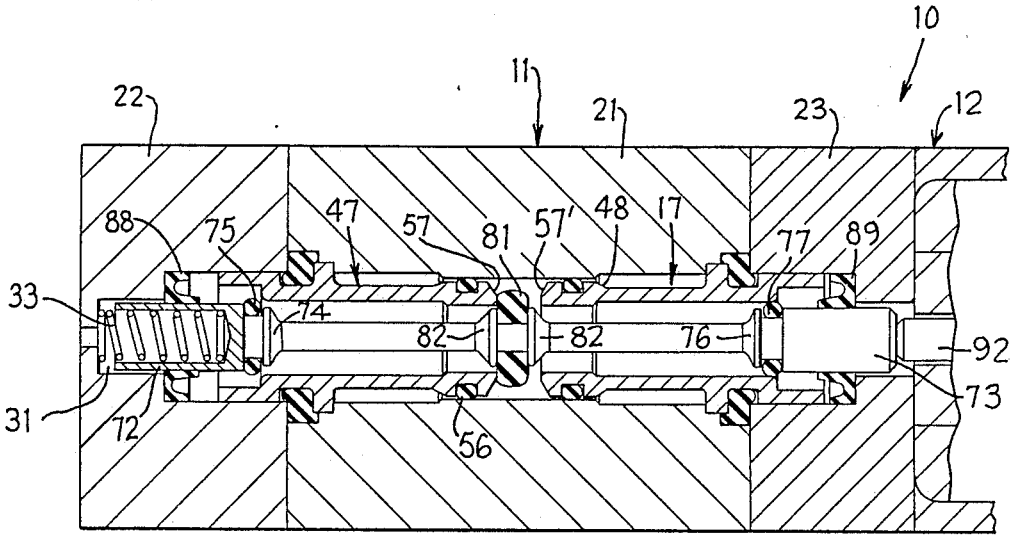
FIG. 2 is a view which corresponds to the valve assembly of FIG. 1 but shows the shiftable valve in its other operational position.

The valve rod 71 has a radially surrounding flange 74 spaced axially from the inner end of the guide portion 72 to define an annular groove therebetween in which an elastomeric O-ring 75 is captivated, the latter being maintained in slidable but sealing engagement with the inner wall defining the bore 58. A similar flange 76 is provided adjacent the other guide portion 73 to captivate a further elastomeric O-ring 77 therebetween, which O-ring is axially slidably but sealingly engaged with the wall defining the bore 58'. These O-rings 75 and 77 are axially spaced apart by a distance which is approximately equal to but normally slightly less than the spacing between the slots 67—67' which communicate with the discharge ports 44–45. When the valve 17 is in the normal end position illustrated by FIG. 1, the O-ring 75 creates an annular seal with the liner 47 just upstream of the discharge port 44 so as to close off the latter, whereas the other O-ring 77 is spaced axially outwardly so as to permit the discharge port 45 to communicate with the bore of the liner 48. When the valve is in its other end position as illustrated by FIG. 2, then the positional and operative relationships of the O-rings 75 and 77 are reversed.

The valve 17, substantially at the midpoint thereof, also stationarily mounts thereon a surrounding elastomeric poppet ring 81, the latter being captivated between flanges 82. This poppet ring 81 is of greater outer diameter than the adjacent portions of the valve stem, and has an axial width less than the axial spacing between the opposed valve seats 57—57'. The spring 33 normally biases the valve into the end position illustrated in FIG. 1 so that one side of the poppet 81 is normally maintained in sealing engagement with the valve seat 57'. Shifting of the valve to the opposite position illustrated in FIG. 2 results in the poppet being shifted leftwardly so that it disengages the valve seat 57', and instead sealingly engages the other valve seat 57. The sealing engagement of the poppet 81 with the valve seat 57 or 57' occurs at a diameter which is only slightly greater than the diameter of the liner bores.

Considering now the operator assembly 12, it is substantially conventional and will be only briefly described.

Operator 12 is a generally conventional electrically actuated solenoid arrangement having a housing 86 which mounts therein a conventional solenoid winding 87, the latter surrounding an inner housing sleeve 88 which defines a bore 89, which is substantially aligned with the bore in the valve assembly. A solenoid plunger sleeve 91 is slidably supported within the bore 89, and additionally includes a plunger rod 92 slidably supported coaxially thereon so that one end of this rod 92 is adapted to project outwardly for alignment with and abutting contact with the free end of the valve rod 71. This plunger rod 92 has the other end thereof adapted to abuttingly contact a stop 93 which is threadably adjustably secured to the plunger sleeve 91. When the solenoid is energized, plunger sleeve 91 and rod 92 are moved axially inwardly (leftwardly in FIG. 1) so as to shift the valve 17 from the position illustrated by FIG. 1 into the end position illustrated by FIG. 2. Upon deenergization of the solenoid, the spring 33 then effects return shifting so as to return the overall assembly into the FIG. 1 position.

To achieve a high degree of pressure balance on the valve 17 at either end position, there is provided a resilient or elastomeric seal ring 88 for creating a slidable sealed engagement with the outer wall of the cylindrical guide portion 72. This seal ring 88 is seated on the shoulder 29 and also creates a sealed engagement with the end housing part 22. A similar elastomeric seal ring 89 slidably sealingly engages the outer wall of the other cylindrical guide portion 73 and is seated on the shoulder 34 so as to sealingly engage the other end housing part 23. Each of these seal rings 88 and 89 preferably comprise a channel-shaped cup seal having the legs thereof directed so that the channel opens inwardly toward the pressure area of the valve assembly. These cup seals 88 and 89 are both disposed so as to be located axially outwardly from the respective discharge ports 44 and 45.

Figure 3:
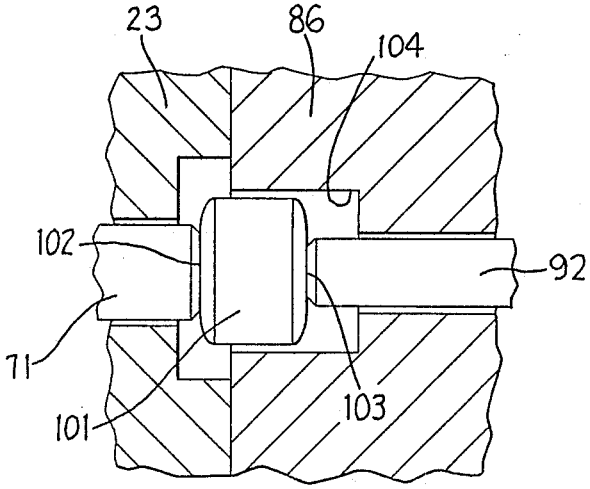
FIG. 3 is a fragmentary view of a preferred variation.

Referring to FIG. 3, there is illustrated the preferred variation wherein a substantially cylindrical disk like buffer member 101 is interposed axially between the free ends of the operator plunger rod 92 and the valve rod 71. This buffer member 101 is generally of significantly larger diameter than the plunger rod 92, the latter typically being of significantly smaller diameter than the free end of the valve rod 71. The member 101 is also generally of slightly larger diameter than the end of the rod 71. The buffer member 101 has an outer cylindrical wall which is axially slidably guided within a cylindrical guide bore 104 formed in the operator housing 86. The buffer member 101 has parallel and planar end surfaces 102 and 103 facing axially in opposite directions for respective abutting contact with the free ends of the valve rod 71 and plunger rod 92. Since the valve rod 71 is preferably constructed of brass, the provision of the intermediate buffer 101 greatly facilitates transfer of axial force between the rods 71 and 92 without causing undesirable wear of the rod 71. The buffer member 101 is preferably of stainless steel, as is the plunger rod 92.

OPERATION

With the valve assembly in the normal position illustrated by FIG. 1, pressure fluid supplied through port 41 passes through bore 58 into load port 42. Similarly, the other load port 43 is connected with discharge port 45 through the bore 58'. Since the O-ring 75 sealingly engages the bore 58, and similarly the poppet 81 sealingly engages the valve seat 57' along a diameter which is substantially the same as the diameter of bore 58, the forces imposed on the valve 17 by the pressure fluid are substantially balanced in opposite axial directions.

When a supply of pressure fluid to the other load port 43 is desired, the solenoid is energized to shift the valve 17 leftwardly so that the poppet 81 engages the valve seat 57, which in turn also causes the O-ring 77 to sealingly engage the wall of the bore 58'. The other O-ring 75 disengages the wall of the bore 58. Load port 42 is connected to the discharge port 44, and the inlet port 41 is connected to the load port 43. When in this latter shifted position as illustrated by FIG. 2, the pressure forces again are substantially balanced axially along the valve.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A four-way valve assembly, comprising:

a housing having a center housing part and first and second end housing parts fixedly attached to opposite ends of said center housing part, said housing defining bore means therein, said bore means including a main bore which extends through said main housing part and first and second end bores which are respectively formed in said first and second end housing parts and are coaxially aligned with opposite ends of said main bore;

first and second substantially identical sleevelike liners sealingly and stationarily supported within said main bore in axially spaced relation, said first and second liners having the inner ends thereof disposed in adjacent but axially spaced relationship and respectively defining thereon first and second annular valve seats which are axially spaced and axially face one another, said first and second valve seats being disposed in surrounding relationship to first and second bores which extend coaxially through the respective first and second liners;

said first liner having a sleevelike hub part associated with an outer end thereof, said sleevelike hub part projecting coaxially into said first end bore so as to concentrically align the latter relative to said main bore;

said second liner having a sleevelike hub part associated with an outer end thereof, said sleevelike hub part projecting coaxially into said second end bore so as to concentrically align the latter relative to said main bore;

a supply port formed in said housing and communicating with said main bore at a location between said first and second valve seats;

first and second load ports formed in said housing and communicating with said main bore at locations which are disposed on axially opposite sides of said supply port, said first and second liners respectively having opening means extending radially therethrough for providing communication between the respective bore and the respective first and second load ports;

a first discharge port formed in said first end housing part and communicating with said first end bore;

a second discharge port formed in said second end housing part and communicating with said second end bore;

a single elongated valve disposed within and extending along said bores and being shiftable between first and second end positions for respectively establishing fluid connection of said first and second load ports to said supply port and said second discharge port when in a first end position, and for respectively establishing fluid connection of the first and second load ports to the first discharge port and the supply port when in the second end position;

said valve including a single elongated rodlike valve stem extending axially throughout said bores and having a single elastomeric poppet ring stationarily mounted thereon in surrounding relationship thereto, said poppet ring being disposed in the space between said opposed valve seats and having the opposite sides thereof disposed for alternate sealing engagement with said second and first valve seats when the valve is shifted between said first and second end positions; and said valve stem having first and second sealing rings mounted thereon adjacent the opposite ends thereof and disposed for slidable sealing engagement with the respective first and second liners for selectively controlling the opening and closing of said first and second discharge ports respectively in response to shifting movement of said valve.

2. A valve assembly according to claim 1, including first and second cylindrical guide parts integrally provided on said rodlike valve stem adjacent axially opposite ends thereof, and first and second guide bores respectively formed in said first and second end housing parts so as to be respectively coaxially aligned and in communication with said first and second end bores, said first and second guide bores being of smaller diameter than the respectively adjacent first and second end bores, said first and second cylindrical guide parts being respectively axially slidably guided directly within said first and second guide bores, and said first and second sealing rings being mounted on said valve stem axially adjacent but spaced slightly axially inwardly from the respective first and second cylindrical guide parts.

3. A four-way valve assembly, comprising:

housing means including a main housing part and first and second end housing parts fixedly attached to opposite ends of said main housing part;

bore means formed in said housing means and including a main bore which extends through said main housing part and first and second end bores formed in the respective first and second end housing parts and disposed in alignment and open communication with opposite ends of said main bore;

a supply port formed in said main housing part and communicating with said main bore substantially adjacent the midpoint thereof, and first and second load ports formed in said main housing part and communicating with said main bore on axially opposite sides of said supply port;

a first discharge port formed in said first end housing part and communicating with said first end bore, and a second discharge port formed in said second end housing part and communicating with said second end bore;

first and second axially elongated sleevelike liners positioned within said bore means and projecting axially outwardly of said bore means in opposite directions from opposite sides of said supply port, said first and second liners being substantially identical and disposed so as to be a mirror image of one another relative to a central transverse plane extending through said supply port, said liners having annular valve seats formed on axially inner ends thereof, said valve seats being disposed on axially opposite sides of said supply port and disposed in axially facing relationship to one another;

each said liner having a cylindrical hub part projecting outwardly from an outer axial end thereof into the end bore of the respectively adjacent housing end part for concentrically and supportingly aligning said end bore with said main bore; and a single elongated and axially shiftable valve slidably supported within said liners for controlling flow of fluid between said ports, said valve having radially enlarged annular elastomeric poppet means mounted thereon substantially axially midway thereof and disposed between the axially facing valve seats for creating sealing engagement with one or the other valve seat as the valve is axially shifted between one or the other end position.

4. A valve assembly according to claim 3, including spring means coacting between said housing means and one end of said valve for normally urging said valve axially into said one end position, and plunger means cooperating with the other end of said valve for permitting shifting of said valve into said other end position in opposition to the urging of said spring means, said plunger means including electrical solenoid means having an axially shiftable plunger rod disposed in coaxial alignment with said valve, and a separate disk like buffer member axially slidably supported on the plunger housing and axially interposed between said valve and said plunger rod.

5. A valve assembly according to claim 3, including spring means coacting between said housing means and one end of said valve for normally urging said valve axially into said one end position, and plunger means cooperating with the other end of said valve for permitting shifting of said valve into said other end position in opposition to the urging of said spring means, said plunger means including electrical solenoid means having an axially shiftable plunger rod disposed in coaxial alignment with said valve.

6. A valve assembly according to claim 3, wherein said first end housing part has a first guide bore which is formed therein in coaxial alignment and communication with said first end bore, said second end housing part having a second guide bore formed therein in coaxial alignment and communication with said second end bore, said first and second guide bores being spaced axially from the cylindrical hub parts of the respective liners, and said shiftable valve having first and second cylindrical guide parts provided adjacent opposite axial ends thereof and disposed for direct axial sliding and guiding engagement within said first and second guide bores respectively.

7. A valve assembly according to claim 6, wherein said valve comprises a single one-piece elongated stem having said cylindrical guide parts defined on opposite ends thereof and having said elastomeric poppet means mounted thereon in surrounding relationship thereto, said valve also including first and second sealing rings mounted on said stem in surrounding relationship thereto and disposed for slidable sealing engagement with the respective first and second liners for selectively controlling the opening and closing of said first and second discharge ports in response to shifting movement of said valve, said first and second sealing rings being mounted on said stem adjacent opposite ends thereof but disposed axially inwardly from the respective first and second cylindrical guide parts.

8. A valve assembly according to claim 7, including spring means for normally urging said valve axially into said one end position, and electrical solenoid means having an axially shiftable plunger rod disposed in coaxial alignment with said valve for permitting shifting of said valve into said other end position in opposition to the urging of said spring means, and a separate disklike buffer member axially interposed between said stem and said plunger rod, said buffer member being of larger diameter than the adjacent end of the stem which is contacted by said buffer member.

9. A four-way valve assembly, comprising:

housing means including a main housing part and first and second end housing parts fixedly but releasably attached to opposite ends of said main housing part;

bore means formed in said housing means and including a main bore which extends through said main housing part and first and second end bores formed in the respective first and second end housing parts and disposed in alignment and open communication with opposite ends of said main bore;

a supply port formed in said main housing part and communicating with said main bore substantially adjacent the midpoint thereof, and first and second load ports formed in said main housing part and communicating with said main bore on axially opposite sides of said supply port;

a first discharge port formed in said first end housing part and communicating with said first end bore, and a second discharge port formed in said second end housing part and communicating with said second end bore;

first and second axially elongated sleevelike liners positioned within said bore means and projecting axially outwardly of said bore means in opposite directions from opposite sides of said supply port, said first and second liners being substantially identical and disposed so as to be a mirror image of one another relative to a central transverse plane extending through said supply port, said liners having annular valve seats formed on axially inner ends thereof, said valve seats being disposed substantially on axially opposite sides of said supply port;

each said liner having a cylindrical hub part projecting outwardly from an axially outer end thereof into the end bore of the respectively adjacent housing end part; and a single elongated and axially shiftable valve slidably supported within said liners for controlling flow of fluid being said ports, said valve having radially enlarged elastomeric ring means mounted thereon substantially axially midway thereof and disposed axially between the valve seats for creating sealing engagement with one or the other valve seat as the valve is shifted axially between one of the other end position.

10. A valve assembly according to claim 9, wherein said elastomeric ring means comprises a single elastomeric ring having a maximum diameter which is greater than the inner diameter of said liners so that said elastomeric ring cannot pass into the bore defined by said inner diameter.

* * * * *